US005688563A

United States Patent [19]

Louks et al.

[11] Patent Number: 5,688,563

[45] Date of Patent: Nov. 18, 1997

[54] ELECTROSTATIC SYSTEM FOR CONTROLLING THE FLOW OF A FLUID AFTER BEING COATED ONTO A SUBSTRATE

[75] Inventors: John W. Louks, North Hudson, Wis.; Steven H. Gotz, Woodbury, Minn.

[73] Assignee: Minnesota Mining and Manufacturing Company, St. Paul, Minn.

[21] Appl. No.: 608,981

[22] Filed: Feb. 29, 1996

Related U.S. Application Data

[63] Continuation of Ser. No. 310,847, Sep. 22, 1994, abandoned.

[51] Int. Cl.[6] ..... B05D 1/30; B05B 5/16; B05C 5/02

[52] U.S. Cl. ..... 427/472; 427/482; 118/624; 118/625; 118/638

[58] Field of Search ..... 427/472, 482, 427/458; 118/624, 625, 638; 34/381, 382, 385, 388, 577, 250, 253, 254

[56] References Cited

U.S. PATENT DOCUMENTS

| | | | |
|---|---|---|---|
| 2,187,624 | 1/1940 | Melton et al. | 118/638 |
| 2,589,034 | 3/1952 | Beedy | 427/458 |
| 2,723,921 | 11/1955 | Starkey | 427/477 |
| 2,795,516 | 6/1957 | Miller | 427/478 |
| 3,088,850 | 5/1963 | Brichard et al. | 428/432 |
| 3,462,286 | 8/1969 | De Geest | 427/482 |
| 3,633,282 | 1/1972 | Candor et al. | 34/1 |
| 4,032,671 | 6/1977 | Hyde | 427/469 |
| 4,513,683 | 4/1985 | Kisler | 118/620 |
| 4,776,997 | 10/1988 | Chino et al. | 264/40.2 |
| 4,826,703 | 5/1989 | Kisler | 427/14.1 |
| 4,990,359 | 2/1991 | Knobbe | 427/482 |
| 5,028,450 | 7/1991 | Naka et al. | 427/9 |
| 5,190,588 | 3/1993 | Matushita et al. | 118/635 |
| 5,194,092 | 3/1993 | Terasawa et al. | 118/632 |

FOREIGN PATENT DOCUMENTS

| | | |
|---|---|---|
| 0 055 985 A2 | 7/1982 | European Pat. Off. . |
| 0 055 985 B1 | 4/1987 | European Pat. Off. . |
| 0 465 012 A2 | 1/1992 | European Pat. Off. . |
| 690692 | 4/1953 | United Kingdom . |

*Primary Examiner*—Shrive Beck
*Assistant Examiner*—Fred J. Parker
*Attorney, Agent, or Firm*—Gary L. Griswold; Walter N. Kirn; Charles D. Levine

[57] ABSTRACT

A system controls the flow of a conductive fluid after the fluid is coated onto a substrate by applying an electrostatic force to the coated fluid. The force applied to the fluid can be controlled to counteract the fluid tendency to dewet to a thicker state if significant interfacial surface tension differences exists between the fluid and substrate.

25 Claims, 5 Drawing Sheets

ELECTROSTATIC SYSTEM FOR CONTROLLING THE FLOW OF A FLUID AFTER BEING COATED ONTO A SUBSTRATE

This is a continuation of application Ser. No. 08/310,847 filed Sep. 22, 1994 abandoned.

TECHNICAL FIELD

This invention relates to a system for controlling the flow of a fluid after being coated onto a substrate. More specifically, this invention relates to a system for preventing or reducing dewetting by the fluid after being coated onto the substrate.

BACKGROUND OF THE INVENTION

Various apparatus and methods for coating fluids onto substrates are widely used. Fluids, such as liquid adhesives, binders, and primers are commonly coated onto substrates, such as films, woven and nonwoven webs, and liners. The term "coat" or "coater" refers to extrusion, knife over roll, slot, curtain, reverse roll, and slide coating methods, as well as other means of applying a fluid to a substrate. Hence, coating a fluid onto a substrate creates a coated substrate.

A goal when coating fluids is to maintain or control the desired coating caliper and coating width. Caliper is measured with devices such as beta gages, and width is measured with devices such as photocells. The coating caliper often affects the properties of the coating such as the tack of coated adhesive. The caliper also affects the cost of the finished product.

The coating width affects the efficient use of the fluid and substrate on which the fluid is coated, such as, the film on which adhesive is coated to produce adhesive tape. When the full effective width of the substrate is coated, it can be slit into more rolls than if less than the full width were coated. Because the cost of the film is a significant component of the overall cost of adhesive tape, efficient use of the film is imperative for cost-effective production.

It is well known that some fluids, when coated onto a particular substrate, have a tendency to "dewet" the substrate surface. Dewetting occurs at the fluid/substrate interface due to the interfacial tension differences between the fluid and the substrate. Generally, the magnitude of dewetting increases with increased surface tension of the fluid and with decreased surface energy of the substrate. Additionally, the tendency of a fluid to dewet is enhanced by localized thin areas created by the coater and by the presence of particles. The contact angle between the fluid and the substrate on which the fluid rests is an indication of and is directly proportional to the magnitude of dewetting.

If the tendency to dewet exceeds the combination of the gravitational force, which acts downwardly on the fluid when the substrate is horizontal and the fluid is on the top surface of the substrate, and viscous forces, which resist the flow of the fluid, the fluid will dewet from a portion of the substrate. This dewetting phenomenon is most easily observed when a low viscosity, high surface tension fluid is thinly coated onto a low surface energy substrate. Examples of low viscosity, high surface tension, conductive fluids are water-based solutions, mixtures, and emulsions, such as latex adhesives, binders, and primers. Examples of low surface energy substrates include silicone-coated liners, and various product backings, such as polymeric films (e.g., non-corona-treated, biaxially-oriented polypropylene), coated papers, and woven and nonwoven webs.

FIG. 1 shows a fluid 2 just after being coated to a particular initial width $W_1$ and caliper $C_1$ onto a substrate 4 to form a coated substrate 6. The initial or dynamic contact angle $A_1$ between the fluid 2 and the substrate 4 is also shown.

After some period of time, the fluid 2 flows inwardly to a thicker equilibrium caliper $C_2$ and a narrower equilibrium width $W_2$ due to the dewetting phenomenon, as shown in FIG. 2. The equilibrium or static contact angle $A_2$ is shown in FIG. 2.

Rather than flow together as shown in FIG. 2, the fluid 2 could have separated causing a coating void 18 as shown in FIG. 3. The dewetting flow shown in either FIG. 2 or FIG. 3 stops when the gravitational, the viscous, and the dewetting forces are in equilibrium. The period of time to reach this equilibrium depends largely on the viscosity of the fluid 2 and the magnitude of the dewetting force.

One undesirable result of this flow is excessive adhesive caliper which can create excessive adhesion, or tack, or reduce the bond of the adhesive to the substrate. Excessive caliper can also require greater drying time for solvent coatings and greater curing time for curable coatings.

Another undesirable result is decreased coating width and increased coating thickness. This causes inefficient use of the coated fluid and the substrate, increasing the cost of the final product.

Still another undesirable result of this flow is the creation of coating streaks or voids, defects known as fisheyes, and less severe caliper variations. Streaks or voids are uncoated areas on the substrate, which can be triggered by the combination of the dewetting tendency and the presence of a foreign particle or localized areas created by the coater. These areas cannot offer the properties provided by the coated substrate. Depending on their size and the importance of complete coating, streaks or voids can render a portion of the substrate unsaleable. Less severe variations of the coating caliper can have similar effects.

To minimize or eliminate this flow, several approaches have been taken. One known method is to add a thickener to the fluid being coated to increase the viscosity. As the viscosity of a fluid increases, the resistance to flow dominates the tendency of the fluid to dewet. However, increasing the viscosity of a fluid prevents air bubbles within the fluid from quickly rising and dissipating. In addition, increasing the viscosity requires higher shear forces to coat the fluid cost-effectively. This is especially true when a thin coating caliper is desired. Furthermore, high shear forces applied to certain shear-sensitive fluids, such as latexes, often causes undesired coagulation.

Another known approach to minimize or eliminate dewetting is to add a surfactant to a fluid. The surfactant lowers the surface tension of the fluid causing the fluid to remain wetted on the substrate. However, the surfactant is often unable to migrate to the substrate surface to lower the surface tension of the fluid in contact with the substrate before dewetting occurs. Also, surfactants can undesirably reduce the adhesion of the coating to the substrate or to a later-joined material and can cause undesirable air bubbles during mixing and coating.

Instead of surfactant, gelatin can be added to the fluid before coating. Immediately after the gelatin-containing fluid is coated, a chiller is used to direct chilled air toward the coated substrate to solidify the gelatin and prevent fluid flow. However, the use of gelatin is not acceptable for all fluid applications.

Another known approach is to coat and dry a higher surface energy priming layer onto the substrate prior to coating the fluid onto the substrate. The higher surface energy of the priming layer decreases the interfacial surface tension differences between the substrate surface and the fluid when the fluid is coated onto the priming layer on the substrate. However, coating and drying the priming layer adds the cost of the primer, the cost of drying the primer, and the cost of purchasing and maintaining the priming and drying equipment. In addition, the priming and drying equipment can require greater floor space.

A wetting process using a continuous electrostatic field is used to cause the fluid to wet out onto the surface of the substrate just as the fluid is coated onto the substrate. This continuous field has been generated below the substrate at the coating location to wet the fluid over the desired width of the substrate. However, with this approach, dewetting can begin to occur downweb from the coater. As a result, this approach has limited utility, such as for fluids and substrates which have a minimal tendency to dewet, or for coating processes where the fluid is dried or set immediately after being coated.

There is a need for a system for preventing dewetting for a sustained period of time after the fluid is coated onto a substrate, but without any of the noted drawbacks.

SUMMARY OF THE INVENTION

The invention is an apparatus for and a method of controlling the flow of a fluid coated onto a substrate without the problems associated by known apparatus and methods. The apparatus is useful for controlling the flow of a fluid on a substrate where interfacial surface tension differences exists between the fluid and the substrate which creates a tendency within the fluid to dewet the substrate. The apparatus can include components for electrostatically controlling the flow of the fluid and for preventing the fluid from entering a sustained state of electrical balance, so that the flow of the fluid remains electrostatically controllable.

The apparatus could include at least one electrostatic field generator which generates a electrostatic field having a field strength. The electrostatic field can be directed toward the fluid to apply an electrostatic force which attracts the fluid toward the field generator. The generator can vary the field strength to allow the electrostatic force to continuously attract the fluid toward the field.

The apparatus could include a first element positioned below the moveable substrate and along a path through which the moveable substrate travels. The first element is electrically chargeable to a first voltage value to create a first electrostatic field having a first field strength. The first electrostatic field attracts the fluid toward the first element. A second element is positioned adjacent to the first element, below the moveable substrate, and along the path through which the moveable substrate travels. The second element is electrically chargeable to a second voltage value to create a second electrostatic field having a second field strength which is different than the first field strength. The second electrostatic field attracts the fluid toward the second element.

The elements can be spaced a selected distance apart from each other and the coated substrate can be moved past the different strength fields at a selected rate to control the frequency of field strength change applied to the fluid.

Alternatively, the structure for electrostatically controlling the flow of the grounded fluid can instead include a conductive element across which an voltage is applied. The voltage can oscillate to selected voltage values and at a selected frequency to create a varying strength electrostatic field which attracts the fluid to the substrate.

The apparatus can further include structure for measuring the coating width or coating caliper of the coated fluid. This structure also can be used to direct the electrostatically controlling structure to cause the fluid to flow to a selected coated width or caliper provided that the coated fluid is not at the selected coating width or caliper.

The structure for electrostatically controlling the flow of the fluid can include charged area elements positioned adjacent areas of the coated substrate. The measuring and directing structure can measure portions of the coated substrate and individually control the voltage across the area elements to create one or more electrostatic fields. The fields cause the measured area of the fluid to remain at a selected coating caliper.

The present invention also includes methods of using the previously mentioned apparatus.

DETAILED DESCRIPTION OF PREFERRED EMBODIMENTS

Figure 1:
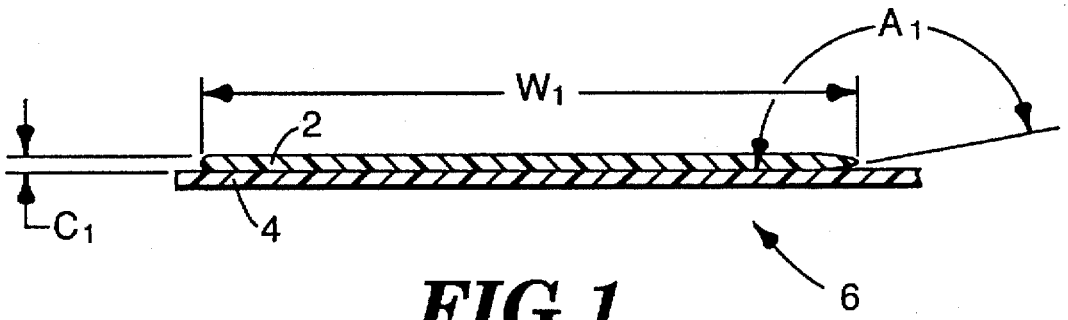
FIG. 1 is a cross-sectional view of a coated substrate immediately after a fluid is coated onto the substrate.
Figure 2:
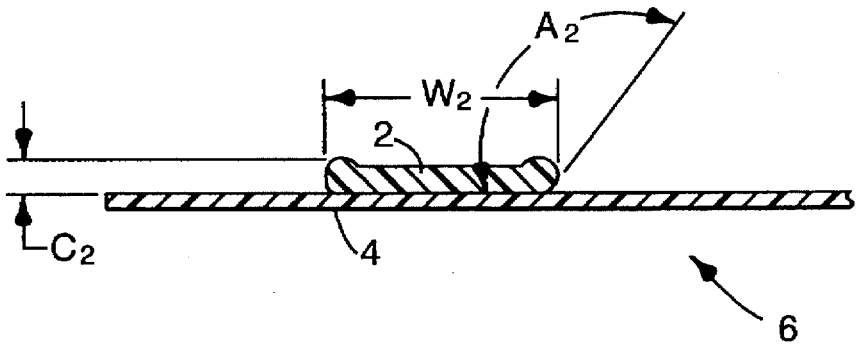
FIG. 2 is a cross-sectional view of the coated substrate of FIG. 1 after a period of time during which the fluid has flowed inwardly and dewetted the outer portions of the substrate.
Figure 3:
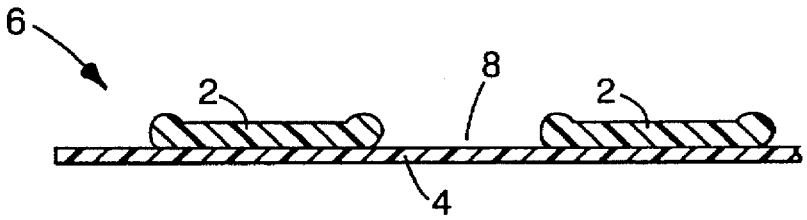
FIG. 3 is a cross-sectional view of the coated substrate of FIG. 1 after a period of time during which the fluid has flowed together, dewetted a portion of the substrate, and caused a coating void.
Figure 4:
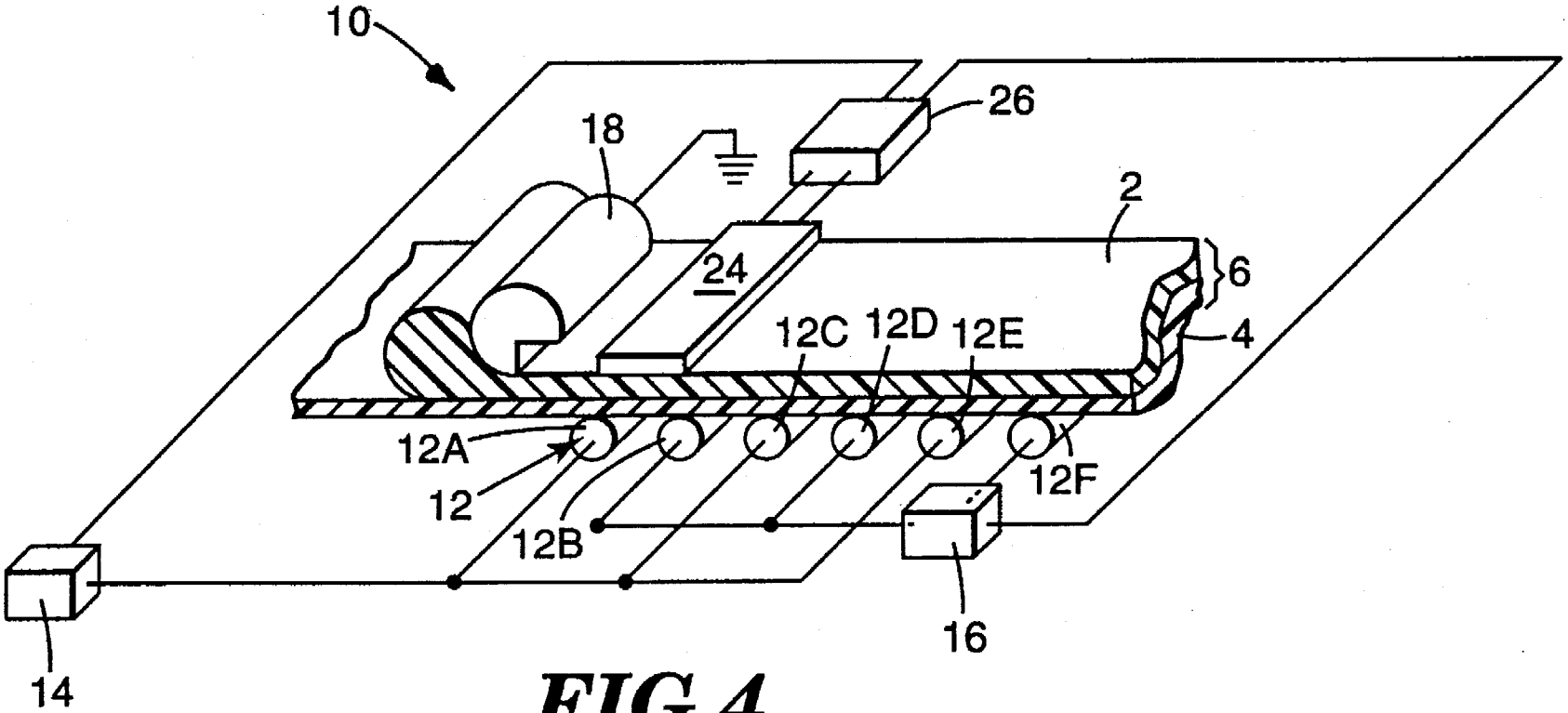
FIG. 4 is a schematic perspective view of one embodiment of the invention including multiple rods alternately charged across which the coated substrate is transported.

A multi-element apparatus 10 of the present invention controls the flow of a fluid 2 after the fluid 2 has been coated onto a substrate 4, as shown in FIG. 4. Controlling the flow includes maintaining the position of the fluid 2. But, controlling the flow also includes retarding the flow due to, for example, the tendency of the fluid 2 to dewet, as well as creating some degree of flow to reduce caliper variations in the fluid 2 created by, for example, the coater.

The fluid 2 can be a solution (i.e., solvent-based), mixture, or emulsion which is useful as, for example, an adhesive, a binder, or a primer. The fluid 2 can be a water-based fluid, such as a latex, or a non-water-based fluid, such as a heptane, toluene, or another organic solvent-based fluid. The fluid 2 can also be a 100% solids, curable polymer. The substrate 4 can be a process liner, a product liner or backing, or some other type of substrate. The controlling or retarding of dewetting of the fluid 2 by the apparatus 10 can depend on the conductivity, viscosity, and surface tension of the fluid 2 and the surface energy of the substrate 4.

Rather than relying on additives, such as surfactants or thickeners, to control the flow of the fluid 2, the multi-element apparatus 10 uses electrostatics. The multi-element apparatus 10 shown in FIG. 4 can control dewetting by applying one or more electrostatic fields to the coated substrate 6. For a field to affect the fluid 2, the fluid 2 must be at least slightly conductive.

When the electrostatic fields are applied to the fluid 2, charges flow within the fluid 2 to offset the imposed field. The flow of the charges results in an electrostatic force (not shown), between the charges in the fluid 2 and the in the field, which pulls the fluid 2 toward the field. Although the effect of the electrostatic force on the fluid 2 partly depends on the level of conductivity of the fluid 2, the multi-element apparatus 10 is effective over a broad conductivity range.

When the electrostatic fields are applied from the non-coated side of the coated substrate 6, the electrostatic force pulls the fluid 2 downwardly against the substrate 4 in the orientation shown in FIG. 4. The downward electrostatic force counteracts dewetting by opposing the fluid's tendency to dewet. Depending on the magnitude of the electrostatic force, the fluid 2 may dewet more slowly, resist dewetting entirely, or begin to spread further over the substrate 4. As a result, the multi-element apparatus 10 can be used to maintain the original coating caliper and width, or can spread the fluid 2 on the substrate 4 to decrease the coating caliper and increase the coating width.

Unlike known electrostatic coating apparatus, however, the multi-element apparatus 10 applies an electrostatic force that prevents or reduces dewetting. To do so, the multi-element apparatus 10 prevents the fluid 2 from reaching or remaining too long within a state of electrical balance which prevents the fluid 2 from relaxing and dewetting. As a result, the multi-element apparatus 10 electrostatically controls the flow of the fluid 2 beyond the duration of control achievable by known electrostatic coating apparatus.

One way that the multi-element apparatus 10 controls fluid flow is by having the ability to alternate the polarity of the electrostatic fields. For example, a first field created by the multi-element apparatus 10 could be positive while a second field could be negative. The alternating fields can be created by two or more alternately-charged elements across which the coated substrate 6 is passed. The conductive elements, shown in FIG. 4 as rods 12A–F, can be charged alternately to selected voltages by connecting one or more rods 12A, 12C, and 12E to a positive power supply 14, and one or more of the remaining rods 12B, 12D, and 12F to a negative power supply 16.

The conductive elements could be made of a conductive material such as metal, graphite, or a conductive plastic. In addition, the conductive elements could be include a core made of a relatively highly conductive material and an outer surface made of a less conductive material. This outer surface could reduce the risk of electrical arcing from the conductive element to the coated substrate 6 or to some other object.

As shown in FIG. 4, the cross-sectional shape of the charged rods 12A–F could be round. However, other shapes would also work, such as square or triangular. In addition, the dimensions of the cross-sectional shape can vary. For example, the charged rods 12A–F could be replaced with corona wires to provide the electrostatic fields.

As the coated substrate 6 is transported above the charged rods 12A–F, the alternating fields either pull image charges in and out of the fluid 2, or forces the image charges to be repositioned within the fluid 2. This satisfies the electrical constraints of the fluid 2 and prevents or interrupts a state of electrical balance within the fluid 2. The imposition of alternating fields results in a pulsing electrostatic force, having a selected frequency of polarity change, that pulls the fluid 2 downwardly thereby opposing the fluid's tendency to dewet.

As shown, the fluid 2 in FIG. 4 can be grounded through the coating knife 18, although grounding can be accomplished other ways. The term "ground" is used here to mean that the fluid 2 can be electrically connected to the earth to have a zero potential with respect to the earth. Being grounded, sufficient charges are available to allow the apparatus 10 to continuously prevent dewetting, for example, as the coated substrate is transported through a coating process.

The same effect can be gained by electrically connecting the fluid 2 to a sufficiently large reservoir of charges, rather than to ground, to allow the apparatus 10 to continuously apply the electrostatic force. For example, the fluid 2 can be electrically connected through the coating knife 18 to a large metallic mass, such as the base of the coating equipment (not shown) of which the apparatus 10 is a part. Or, the fluid 2, itself, can act as its own reservoir of charges if sufficient charges exist either in the fluid 2 coated on the substrate or the fluid 2 within a coater supply tank (not shown).

The spacing between the rods 12A–F and the transport speed of the coated substrate 6 over the alternately charged rods 12 determine the frequency of polarity change. For example, when the rods 12A–F are 15.25 centimeters apart and the coated substrate 6 is transported over rods 12A–F at a speed of between 30.5 and 91.5 centimeters per second, the frequency of polarity change is approximately two to six hertz.

In addition to the frequency of polarity change, or pulse, the selection of the voltage across the rods 12A–F contributes to preventing the dewetting of the fluid 2. These factors can be adjusted to prevent dewetting of a variety fluids, having different viscosities, surface tensions, and conductivities, coated onto a variety of substrates, having different surface energies. For example, the apparatus has been used to prevent dewetting of fluids having viscosities of between 1–10,000 centipoise, surface tensions of between 20–72 dynes, and conductivities from $5.6\times10^{-9}$ to $1.1\times10^{-4}$ Siemens/meter, when coated onto substrates having surface energies of between 18–35 dynes.

In one example, a latex fluid (viscosity 10–10,000 centipoise; conductivity=$1.1\times10^{-4}$ Siemens/meter, and surface tension=35–50 dynes/centimeter) was knife-coated (0.0016 centimeter knife gap) onto a silicone-coated paper substrate (surface energy=18–35 dynes/centimeter). Without the use of the electrostatic apparatus 10, circular defects (voids, fisheyes) occurred naturally. Streak defects were intentionally created by partially obstructing the knife gap in localized areas. When the electrostatic apparatus 10 was engaged (±1000–7000 volts; 2–6 hertz), the occurrence of the circular defects was reduced by 50–67%, and the size of the circular defects was reduced by 75%. The width of the intentionally created streaks was reduced by 50%. These defect-reduction measurements were taken between 122 and 244 centimeters from the coater.

In another example, the same materials were controlled using the single-element apparatus 20, shown having a plate 22 rather than charged rods 12A–F. The fluid 2 was knife-coated with a 0.002 centimeter gap to a 5-centimeter coating width. Without engaging the electrostatic apparatus 10, the fluid 2 dewetted to a width of 2.5 centimeters within eight seconds. When the electrostatic apparatus 10 was engaged (voltage=pulsed between 0–20,000 volts; frequency=3 hertz), the fluid dewetted to a width of 3.2 centimeters in 105 seconds. A similar example using a higher-viscosity latex virtually eliminated dewetting.

For even lower conductivity fluids, such as deionized water (conductivity=$5.6\times10^{-6}$ Siemens/meter) or propylene glycol (conductivity=$5.6\times10^{-9}$ Siemens/meter), the single-element apparatus 20 has been shown to provide adequate electrostatic force to prevent dewetting. For example, the dewetting of propylene glycol on a silicone-coated release liner has been prevented by applying a voltage of approximately 10,000 volts. Higher voltages applied to this fluid or to those previously mentioned would provide a greater electrostatic force to prevent dewetting, such as if the voltage were increased to or in excess of 50,000 volts.

The same effect of preventing dewetting can be accomplished byways other than alternating the polarity of the electrostatic fields created by the charged rods 12A–F or the plate 22. For example, by applying a higher positive voltage across rod 12A than the positive voltage applied across either of other rods 12B–F, the multi-element apparatus 10 creates electrostatic fields of varying strengths, though having the same polarity. Similarly, the voltages across 12A–F could be negative. In either case, this creates a direct pulse electrostatic fields, as opposed to alternating pulse electrostatic fields. And, like the alternating pulse electrostatic fields, the direct pulse electrostatic fields need not be created by pulsing only between two chosen voltage values and at a set frequency. For example, the voltage values can oscillate from 1000 volts to 7000 volts, then from 2000 volts to 7500 volts, and the frequency can be varying from two hertz to six hertz.

Still another approach to provide the same effect involves using the multi-element apparatus 10 and applying the same voltage across each element. With this approach, one element could be positioned at a different distance from the coated substrate 6 than another element to apply fields of different strengths to the coated substrate 6. Or, the elements could be positioned at the same distance from the coated substrate 6, but sufficiently spaced from each other so that the electrostatic field applied to the coated substrate 6 diminishes between the elements.

The multi-element apparatus 10 can reduce, prevent, or reverse dewetting by applying an oscillating voltage across at least one of the adjacent rods 12A–F. This oscillation creates at least one electrostatic field of varying strengths and can include a polarity change to create electrostatic field or both varying strength and polarity. This approach likewise creates the pulsed electrostatic force and prevents or interrupts an electrical balance within the fluid 2.

Figure 5:
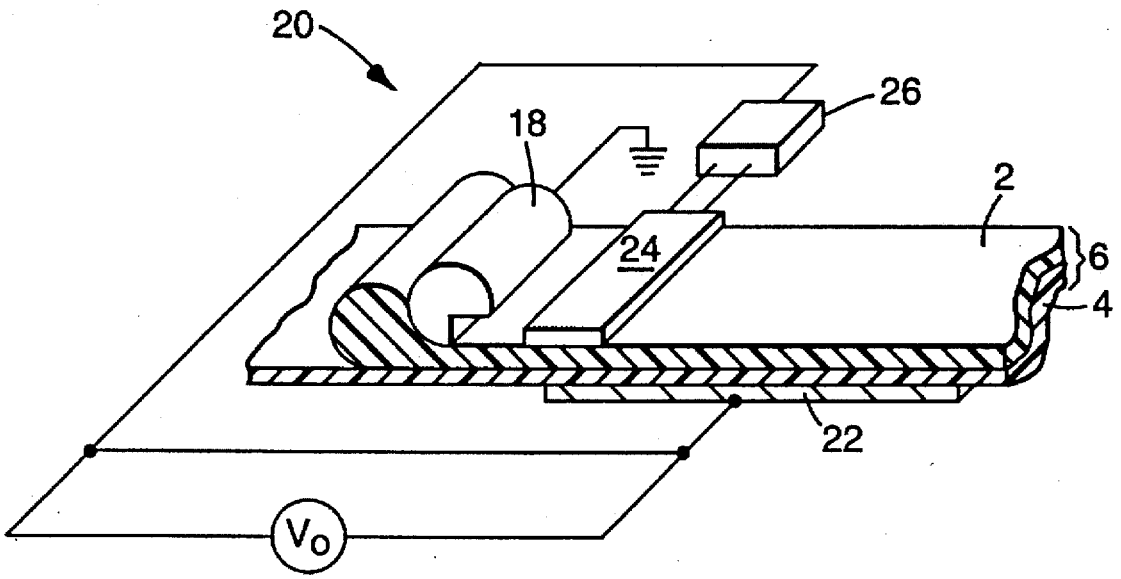
FIG. 5 is a schematic perspective view of another embodiment of the invention including a large conductive plate through which an alternating current or a pulsed direct current flows.

As noted, for a single-element apparatus 20, the rods 12A–F of FIG. 4 can be replaced by a single conductive element, such as the plate 22 shown in FIG. 5. An oscillating voltage $V_O$ can be applied across the plate 22 and have a selected frequency. The frequency of oscillation can be controlled in conjunction with the selected transport speed of the coated substrate 6 over the plate 22 to create the same effect as the adjacent rods 12A–F. The length of the plate 22 placed below the coated substrate 6 can be chosen to apply the electrostatic force to the fluid 2 for the requisite distance or time.

Other similar arrangements could apply a single electrostatic field that varies in field strength, polarity, frequency, or some combination thereof to prevent or interrupt the electrical balance within the fluid 2. Also, other arrangements could apply multiple electrostatic fields which have different or varying field strengths, polarities, frequencies, or some combination thereof to prevent or interrupt the electrical balance within the fluid 2.

The multiple-element apparatus 10 or the single-element apparatus 20 can also include one or more measuring devices 24, as shown in FIGS. 4 and 5, capable of measuring the coating caliper, coating width, or both. This measuring device 24 can feed back measurement data to a controlling device, such as a process controller 26. The process controller 26 can be programmed to control the electrostatic force by varying the electrostatic field strength, polarity, frequency, or some combination thereof in response to the measurement data. As a result, the measuring device 24 and process controller 26 can compensate for deviations of coating caliper and the width inherent within the coating process.

Figure 6:
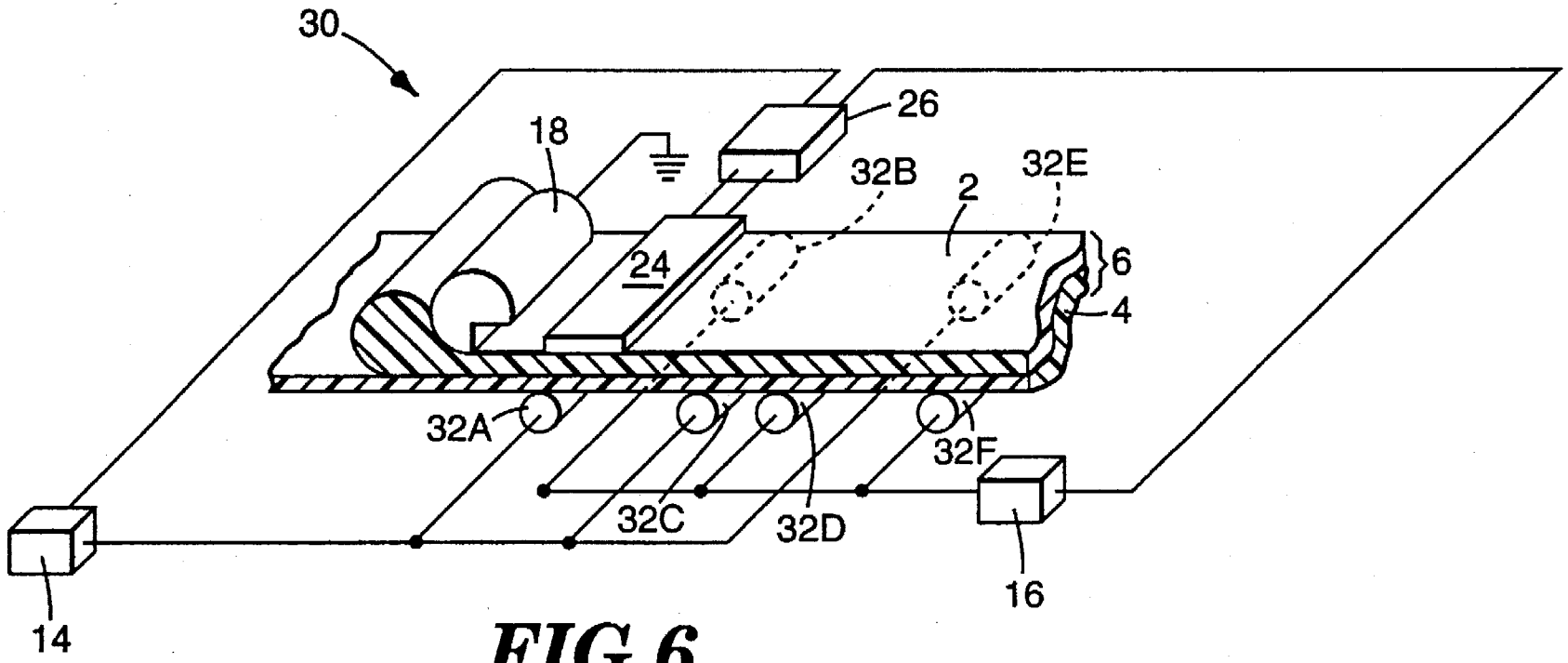
FIG. 6 is a schematic perspective view of another embodiment of the invention including components for measuring and controlling the coating caliper and width.

To reduce a cross-web caliper deviation, an area-element apparatus 30, shown in FIG. 6, could be used. The area-element apparatus 30 includes an arrangement of discrete area elements, such as area rods 32A–F, positioned and controlled to affect the flow of corresponding areas of the fluid 2. As shown, the rods extend for only a portion of the width of the substrate 6 and each of the area rods 32A–F corresponds to a different portion of the width. When the caliper of the area of fluid 2 above area rod 32B is below a target range, the field strength provided by area rod 32B can be increased and the field strength of the other area rods 32A, 32C–F can be reduced.

In addition, the area-element apparatus 30 can apply fields to the edges of the coated fluid 2 to prevent thicker caliper at the edges due to interfacial surface tension. Consistent coating caliper across the substrate 4 allows for easier windup of the coated substrate 4 and a higher quality, wound, coated substrate. This can be accomplished, for example, with one or more discrete area elements positioned near the edge of the coated substrate 6.

Alternatively, the area rods 32A–F could be positioned and sized differently to induce caliper variation if so desired. Additionally, the area-element apparatus 30 could include a measuring device 24 and process controller 26 as described above.

Figure 7:
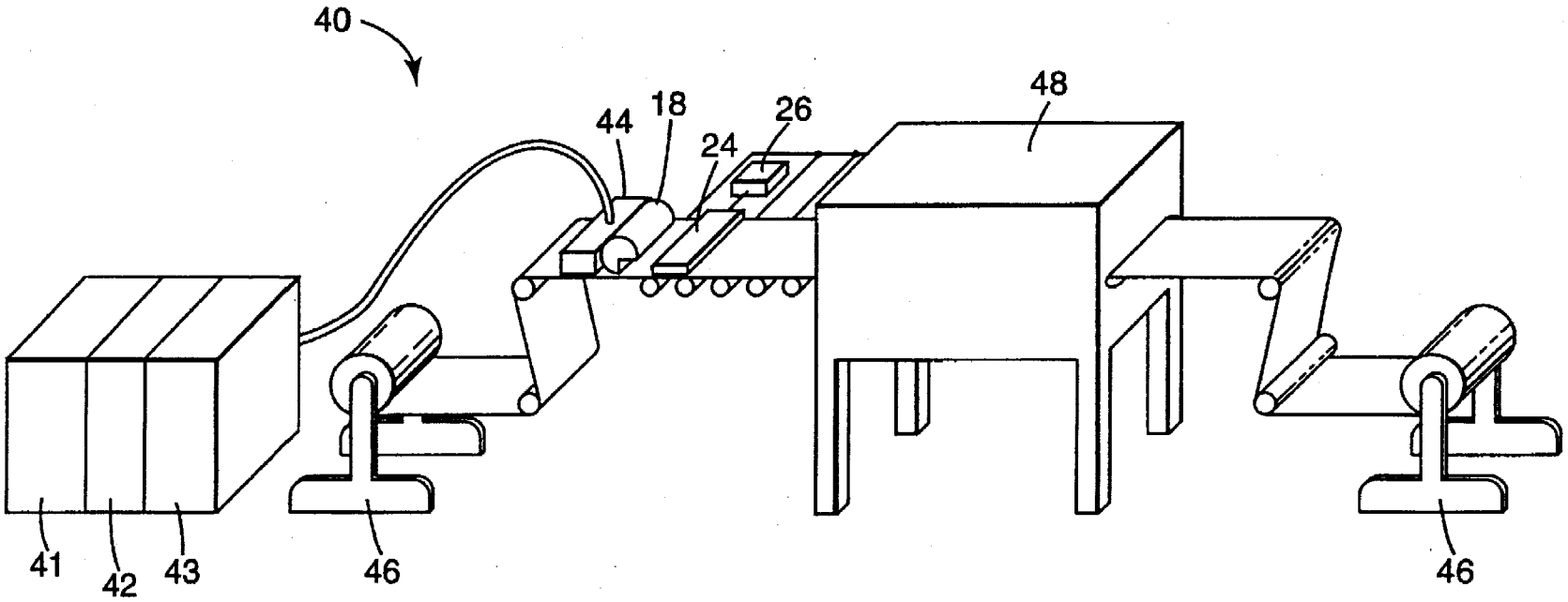
FIG. 7 is a schematic perspective view of another embodiment of the invention including fluid storage and pumping equipment, a coating station, web-handling equipment, and fluid set-up equipment.

Furthermore, the multi-element apparatus 10, the single-element apparatus 20, and the area-element apparatus 30 could include other coating equipment to complement the previously described components. As shown in FIG. 7, such equipment can include a fluid storage device 41, a mixing device 42, a pumping device 43, a coating station 44, and substrate unwinding and winding stands 46. Such equipment can also include a fluid set-up device 48, such as a drying device or a curing device if the fluid 2 is dried or cured after being coated onto the substrate 4. To maintain the desired coating caliper or width, dewetting can be delayed long enough to transport the coated substrate 6 some distance toward or within the set-up 48. As the fluid 2 sets up, the viscosity of the fluid 2 will increase to the point where dewetting will no longer occur.

Similarly, the above-mentioned apparatus and coating equipment could include components for reducing the static electricity build-up on the coated substrate 6. One such component could be a material referred to as "tinsel" which is suspended just below the coated substrate 6 to neutralize static electricity. The tinsel can be electrically grounded by being connected to, for example, a grounding wire. Other static reduction components would also function with the above-mentioned apparatus and coating equipment.

We claim:

1. A method for minimizing the flow of a fluid after the fluid is coated by a coater onto a first side of a substrate and until further control of the fluid flow is not needed, the method comprising the steps of:

positioning an electrostatic field generator having at least one element relative to the fluid on the substrate for imposing at least one electrostatic field on the fluid to oppose the dewetting tendency of the fluid and to minimize the flow of the fluid after the fluid is coated onto the substrate, the at least one electrostatic field having a field strength; and subjecting each given point in a desired region on the substrate to a pulsing electrostatic field to vary over time the field strength between a higher and a lower level at least once, thereby to prevent the fluid from becoming electrostatically unaffected by the at least one electrostatic field and to enable the at least one electrostatic field to continue to oppose the dewetting tendency of the fluid.

2. The method of claim 1, the substrate having a second side opposite the first side of the substrate, the electrostatic generator comprising at least a first element and a second element positioned adjacent the second side of the substrate, the first element being charged to a first voltage to create a first electrostatic field having a first field strength and the second element being charged to a second voltage to create a second electrostatic field having a second field strength, the first and second field strengths being different, the first element being spaced from the second element such that the fluid is exposed to the first electrostatic field followed by the second electrostatic field.

3. The method of claim 2, wherein one of the first and second elements is charged to a positive voltage and the other of the first and second elements is charged to a negative voltage.

4. The method of claim 2, the first element being charged to a positive voltage and the second element being charged to a positive voltage.

5. The method of claim 2, the first element being charged to between 1000 volts and 7000 volts and the second element being charged to between negative 1000 volts and negative 7000 volts, the substrate being transported adjacent the first and second elements at a transport rate, the first and second elements being spaced an element distance such that the fluid is exposed to the first electrostatic field from between 1 to 3 seconds before the fluid is exposed to the second electrostatic field.

6. The method of claim 1, the electrostatic field generator comprising a charged element, the at least one electrostatic field imposed by the charged element being a varying-strength electrostatic field.

7. The method of claim 1, further comprising the step of positioning the electrostatic generator between the coater and a drying apparatus to electrostatically minimize the flow of the fluid until the fluid is sufficiently dried by the drying apparatus.

8. The method of claim 1 wherein the positioning step comprises positioning an element of the electrostatic field generator on a second side of the substrate opposite the first side of the substrate.

9. The method of claim 1 wherein the subjecting step comprises pulsing the field strength to create different field strengths on the same side of the substrate.

10. The method of claim 1 wherein the subjecting step comprises spacing multiple electrostatic field elements from each other such that the area between respective elements has a different field strength from that of the adjacent elements, wherein adjacent elements have one of the same field strength and different field strengths.

11. The method of claim 1 further comprising the step of selecting the proper frequency of the electrostatic field in combination with the properties of the fluid.

12. The method of claim 1 wherein the subjecting step comprises pulsing the field strength a plurality of times.

13. A method for minimizing the flow of a fluid after the fluid is coated by a coater onto a first side of a substrate and until further control of the fluid flow is not needed, the substrate having a second side opposite the first side of the substrate, wherein the method comprises the steps of:

positioning an electrostatic field generator relative to the fluid on the substrate for imposing at least one electrostatic field on the fluid to pull the fluid against the first side of the substrate and to minimize the flow of the fluid after the fluid is coated onto the substrate, the at least one electrostatic field having a field strength, wherein the electrostatic generator comprises at least a first element and a second element positioned adjacent the second side of the substrate, the first element being charged to a first voltage to create a first electrostatic field having a first field strength and the second element being charged to a second voltage to create a second electrostatic field having a second field strength, the first and second field strengths being different, the first element being spaced from the second element such that the fluid is exposed to the first electrostatic field followed by the second electrostatic field, the electrostatic generator further comprising a third element and a fourth element positioned adjacent the second side of the substrate, the third element being charged to approximately the first voltage to create a third electrostatic field having approximately the first field strength, the fourth element being charged to approximately the second voltage to create a fourth electrostatic field having approximately the second field strength, the third and fourth elements being spaced from and positioned relative to the first and second elements such that the fluid is consecutively exposed to the first, second, third, and fourth electrostatic fields and such that the fluid is pulsed by electrostatic fields of differing field strengths; and varying the field strength sufficiently to prevent the fluid from becoming electrostatically unaffected by the electrostatic fields and to enable the at least one electrostatic field to continue to pull the fluid against the first side of the substrate.

14. A method for minimizing the flow of a fluid after the fluid is coated by a coater onto a first side of a moving substrate and until the apparatus is not needed to control the flow, the moving substrate having a second side opposite the first side, the method comprising the steps of:

positioning a first element relative to the coater and adjacent the second side of the substrate, the first element being charged to a first voltage such that the first element imposes a first electrostatic field on the fluid pulling the fluid against the first side of the substrate, the first electrostatic field having a first field strength;

positioning a second element relative to the coater and adjacent the second side of the substrate, the second element being charged to a second voltage such that the second element imposes a second electrostatic field on the fluid pulling the fluid against the first side of the substrate, the second electrostatic field having a second field strength, the second field strength being different from the first field strength, the second element being spaced from the first element such that the fluid is exposed to the first electrostatic field before being exposed to the second electrostatic field when transported from the coater;

positioning a third element relative to the coater and adjacent the substrate second side, the third element being charged to a third voltage such that the third element imposes a third electrostatic field on the fluid pulling the fluid against the first side of the substrate, the third electrostatic field having a third field strength, the third field strength being different from the second field strength, the third element being spaced from the first and second elements such that the fluid is exposed to the first electrostatic field before being exposed to the second electrostatic field and such that the fluid is exposed to the second electrostatic field before being exposed to the third electrostatic field when the substrate is transported from the coater; and transporting the moving substrate adjacent the first, second, and third elements at a transport rate after the fluid is coated onto the moving substrate, the transport rate being sufficient to prevent the fluid from becoming electrostatically unaffected by the first, second, and third electrostatic fields and such that the flow of the fluid is minimized by the first, second, and third electrostatic fields.

15. A method for applying a fluid coating onto a first side of a substrate and for controlling the flow of the fluid coating until the fluid coating loses its tendency to flow, the method comprising the steps of:

applying the fluid coating to the first side of the substrate;

imposing at least one electrostatic field on the fluid coating to oppose the dewetting tendency of the fluid and to minimize the flow of the fluid coating after the fluid coating is applied to the substrate;

subjecting each given point in a desired region on the substrate to a pulsing electrostatic field to vary over time the field strength between a higher and a lower level at least once, while imposing the at least one electrostatic field upon the fluid coating, thereby to prevent the fluid from becoming electrostatically unaffected by the at least one electrostatic field and to enable the at least one electrostatic field to continue to oppose the dewetting tendency of the fluid; and solidifying the fluid coating to reduce the fluid tendency to flow while the step of imposing the at least one electrostatic field is taken.

16. An apparatus for controlling the flow of a fluid after the fluid is coated by a coater onto a first side of a substrate and until the apparatus is not needed to control the flow, the apparatus comprising:

an electrostatic field generator positioned relative to the fluid on the substrate for imposing at least one electrostatic field on the fluid to oppose the dewetting tendency of the fluid and to control the flow of the fluid after the fluid is coated onto the substrate, the at least one electrostatic field having a field strength; and means for subjecting each given point on the substrate to a pulsing electrostatic field to vary over time the field strength between a higher and a lower level at least once, thereby to prevent the fluid from becoming electrostatically uncontrollable by the at least one electrostatic field and to enable the at least one electrostatic field to continue to oppose the dewetting tendency of the fluid.

17. The apparatus of claim 16, the substrate having a second side opposite the first side, the electrostatic generator comprising at least a first element and a second element positioned adjacent the second side of the substrate, the first element being charged to a first voltage to create a first electrostatic field having a first field strength and the second element being charged to a second voltage to create a second electrostatic field having a second field strength, the first and second field strengths being different, the first element being spaced from the second element such that the fluid is exposed to the first electrostatic field followed by the second electrostatic field.

18. The apparatus of claim 17, wherein one of the first and second elements being charged to a positive voltage and one of the first and second elements being charged to a negative voltage.

19. The apparatus of claim 17, the first element being charged to a positive voltage and the second element being charged to a positive voltage.

20. The apparatus of claim 17, the first element being charged to a negative voltage and the second element being charged to a negative voltage.

21. The apparatus of claim 17, the first element being charged to between 1000 volts and 7000 volts and the second element being charged to between negative 1000 volts and negative 7000 volts.

22. The apparatus of claim 17, the substrate being transported adjacent the first and second elements at a transport rate, the first and second elements being spaced an element distance such that the fluid is exposed to the first electrostatic field from between 1 to 3 seconds before the fluid is exposed to the second electrostatic field.

23. The apparatus of claim 16, the electrostatic field generator comprising a charged element, the at least one electrostatic field imposed by the charged element being a varying-strength electrostatic field.

24. An apparatus for controlling the flow of a fluid after the fluid is coated by a coater onto a first side of a substrate and until the apparatus is not needed to control the flow, the substrate having a second side opposite the first side, wherein the apparatus comprises:

an electrostatic field generator positioned relative to the fluid on the substrate for imposing at least one electrostatic field on the fluid to pull the fluid against the first side of the substrate and to control the flow of the fluid after the fluid is coated onto the substrate, the at least one electrostatic field having a field strength, the electrostatic generator comprising at least a first element and a second element positioned adjacent the second side of the substrate, the first element being charged to a first voltage to create a first electrostatic field having a first field strength and the second element being charged to a second voltage to create a second electrostatic field having a second field strength, the first and second field strengths being different, the first element being spaced from the second element such that the fluid is exposed to the first electrostatic field followed by the second electrostatic field, the electrostatic generator further comprising a third element and a fourth element positioned adjacent the second side of the substrate, the third element being charged to approximately the first voltage to create a third electrostatic field having approximately the first field strength, the fourth element being charged to approximately the second voltage to create a fourth electrostatic field having approximately the second field strength, the third and fourth elements being spaced from and positioned relative to the first and second elements such that the fluid is consecutively exposed to the first, second, third, and fourth electrostatic fields and such that the fluid is pulsed by electrostatic fields; and means for varying the field strength sufficiently to prevent the fluid from becoming electrostatically uncontrollable by the at least one electrostatic field and to enable the at least one electrostatic field to continue to pull the fluid against the first side of the substrate.

25. An apparatus for controlling the flow of a fluid after the fluid is coated by a coater onto a first side of a moving substrate and until the fluid is sufficiently set up and the apparatus is not needed to control the flow, the moving substrate having a substrate second side opposite the substrate first side, the apparatus comprising:

a first element positioned relative to the coater and adjacent the substrate second side, the first element being charged to a first voltage such that the first element imposes a first electrostatic field on the fluid pulling the fluid against the substrate first side, the first electrostatic field having a first field strength; and a second element positioned relative to the coater and adjacent the second side, the second element being charged to a second voltage such that the second element imposes a second electrostatic field on the fluid pulling the fluid against the substrate first side, the second electrostatic field having a second field strength, the second electrostatic field strength being different from the first electrostatic field strength, the second element being spaced from the first element such that the fluid is exposed to the first electrostatic field before being exposed to the second electrostatic field.

* * * * *